United States Patent [19]

Ogden et al.

[11] Patent Number: 4,635,928

[45] Date of Patent: Jan. 13, 1987

[54] ADJUSTABLE SPEED CONTROL ARRANGEMENT FOR MOTORIZED EXERCISE TREADMILLS

[75] Inventors: Ralph Ogden, Munster; Carl J. Johnson, Crown Point, both of Ind.

[73] Assignee: Ajax Enterprises Corporation, Delavan, Wis.

[21] Appl. No.: 723,140

[22] Filed: Apr. 15, 1985

[51] Int. Cl.[4] ..... A63B 23/06

[52] U.S. Cl. ..... 272/69; 272/DIG. 4

[58] Field of Search ..... 272/69, 73; 474/26, 474/114, 115

[56] References Cited

U.S. PATENT DOCUMENTS

| | | | |
|---|---|---|---|
| 1,449,828 | 5/1923 | Maimin et al. | 474/114 X |
| 2,669,404 | 2/1954 | Howard | 474/114 X |
| 2,963,966 | 12/1960 | Büttner | 474/26 X |
| 3,064,486 | 11/1962 | Aplin | 474/26 X |
| 4,344,616 | 8/1982 | Ogden | 272/69 |
| 4,374,587 | 2/1983 | Ogden | 272/69 |
| 4,381,174 | 4/1983 | Obler | 474/26 X |
| 4,445,683 | 5/1984 | Ogden | 272/69 |

FOREIGN PATENT DOCUMENTS

| | | | |
|---|---|---|---|
| 966865 | 4/1975 | Canada | 272/69 |
| 120015 | 8/1970 | Norway | 272/73 |

*Primary Examiner*—Richard J. Apley
*Assistant Examiner*—David S. Brown
*Attorney, Agent, or Firm*—Mann, McWilliams, Zummer & Sweeney

[57] ABSTRACT

A motorized treadmill exercising device comprising a generally planar frame equipped with a planar slider bed and head and tail rollers journalled respectively at the head and tail ends of the frame, over which an endless plastic belt is trained. The treadmill at its head end is equipped with a cross member that pivotally mounts a motor assembly including an electric drive motor and shaft driven by same that is keyed to a variable speed pulley aligned with an ordinary fixed speed pulley keyed to the treadmill belt head roller, and between which a drive pulley belt of the V type is tensioned by the biasing action of the variable speed pulley that subjects the motor assembly to uniform spring biasing action about the pivotal mounting of the motor assembly for tensioning the pulley belt into drive transmitting relation with the respective pulleys, and with the treadmill apparatus including hand hold railing on either side of same between which the treadmill user exercises, with one of the hand rails having mounted on same and connected with the treadmill drive motor assembly for pivoting same, a control mechanism that is adapted for hand actuation by the treadmill user when using the treadmill, for changing of the tensioning of the pulley belt, and the adjustment of the variable speed pulley, for convenient infinitely variable speed changing of this treadmill belt between its maximum and minimum speeds provided by the treadmill apparatus involved and protection of the drive equipment against damage.

10 Claims, 11 Drawing Figures

ADJUSTABLE SPEED CONTROL ARRANGEMENT FOR MOTORIZED EXERCISE TREADMILLS

This invention relates to exercise treadmills, and more particularly to exercise treadmills of the endless belt type upon which the user may walk for exercise purposes, this application being directed to improvements on the arrangements disclosed in Ogden U.S. Pat. Nos. 4,344,616, 4,374,587, 4,445,683, and Ogden patent application Ser. No. 552,803, filed Nov. 17, 1983 (the disclosure of which and that or said U.S. Pat. No. 4,445,683 are incorporated herein by this reference).

Various forms and types of exercise treadmill assemblies are and have been available for exercise purposes involving endless belts on which the user walks or trots for exercise or diagnostic purposes. However, prior to the inventions of the above identified Ogden patents and patent application, equipment of this type has proved to be unduly expensive to be practical for individuals to have at home for regular exercise use, due to the tendency to incorporate sophisticated monitoring equipment and the overdesigning of the basic apparatus to insure continuous exercise for individuals weighing up to 250 pounds or more, yet permitting adjustment of slope and belt speed to make available to the user mild to exhaustive exercise for testing or conditioning purposes.

A principal object of the present invention is to provide a walking exercise treadmill of few and simple parts that avoids costly sophisticated instrumentation and other equipment not necessary to exercise use as such, while providing the user with the capability of setting the speed of the treadmill belt at predetermined minimum and maximum speeds for walking exercise use, as well as providing the user with ability to infinitely vary the speed setting of the treadmill belt between such minimum and maximum speed levels, without the user having to dismount or get off the treadmill to change the speed setting of the treadmill belt.

Another principal object of the present invention is to provide an exercise treadmill of the endless belt trained, head roller driven, slider bed type, in which the drive arrangement thereof includes a low power electric motor driving the treadmill belt through a pulley keyed to the motor, a pulley keyed to the head roller, and a pulley belt tensioned between such pulleys, in which the treadmill user has available to him, while using the treadmill, for instance, for walking exercise, a treadmill belt speed control device that permits the user to set the treadmill belt speed at any speed between the minimum and maximum provided by the treadmill equipment involved, and also have infinitely variable speed control between the two limits indicated, but which, when the drive motor is deenergized, can be manipulated without actually changing the treadmill belt drive speed setting until the motor is energized.

Yet another basic object of the invention is to provide an exercise treadmill of the endless belt train, head roller driven, slider bed type, in which the drive arrangement thereof includes ahead of the head drive roller a pivotally mounted motor drive assembly including a low power electric motor driving a pulley belt of the "V" type through pulleys keyed to the drive motor and head pulley, respectively, in which the pivotally mounted motor assembly is spring biased for movement about its pivot axis to tension the pulley belt into drive transmitting relation with the respective pulleys, wherein the pulley that is keyed to the drive motor shaft is of the adjustable speed type, the spring biasing action of which on the pulley belt is controlled by a treadmill belt speed control device mounted on the treadmill for convenient operation by the treadmill user while exercising on the treadmill, through tilting of the drive motor assembly by way of a flexible connecting cable connected to and between the drive motor and a reciprocable member in the speed control device.

The reciprocable member of the speed control device has the specific objective of being movable over a predetermined distance by a hand lever to set the belt speed at and between the treadmill belt minimum and maximum speeds in an infinitely variable manner, with the control device also to have built into same a lost motion action that becomes effective when the drive motor is turned off whereby no actual change in the treadmill belt speed is effected, until the drive motor is running, to avoid damaging the equipment when the motor again is energized.

In accordance with the invention, an adjustable speed control for motorized exercise treadmills is provided for exercise treadmills of the type disclosed in said Ogden patents and patent application, which treadmills generally comprise a generally planar platform or frame or deck providing a slider bed, and a driving head roller idler tail roller at the respective head and tail ends of the slider bed, over which is trained an endless belt that is preferably formed from a low long term or creep or stretch resistant synthetic material, such as oriented nylor or polyester film. The treadmill includes an electric drive motor assembly mounted on the slider bed ahead of the treadmill belt head drive roller, and for pivotal movement about an axis that parallels that of the axis of rotation of the head roller, with the drive motor assembly including an electric drive motor having a variable speed pulley keyed to its drive shaft that drives a V type pulley belt which in turn drives a standard pulley that is keyed to the head roller. The drive motor assembly pivot axis is disposed generally below the motor and the plane of the slider bed. The treadmill apparatus is equipped on either side of the slider bed with hand hold railing that preferably is of the "P" shaped configuration disclosed in said Ogden U.S. Pat. No. 4,445,683 and said Ogden application for convenient grasping as needed by the user of the treadmill in mounting or stepping off the treadmill belt from either side of the treadmill assembly.

The treadmill assembly is equipped with a manually actuated speed control mechanism that is mounted on one of the hand hold railings at a position convenient for grasping by the treadmill user, with the speed control mechanism including a housing shiftably mounting a reciprocable member and a hand crank actuation device therefor, for moving the reciprocable member in opposite directions a predetermined distance. Connected between the underside of the electric drive motor, and to a lever arm depending from the drive motor (and passing through the pivot axis of the drive motor assembly), is a flexible cable which extends up to the speed control mechanism where it is connected to the reciprocable member, the cable extending in close fitting relation to and through a coiled wire guide that has one end anchored to the treadmill frame and the other end anchored to the speed control mechanism housing. The variable speed pulley that is keyed to the drive motor drive shaft includes a compression spring for biasing the sheave halves of same to the pulley high speed position, in which position the pulley belt is tensioned to swing the treadmill drive motor assembly about its indicated pivot axis to the maximum speed drive relation thereof, which also maximizes the spacing of the motor lever arm from the treadmill belt head roller axis.

The connection of the treadmill belt speed adjusting cable to the speed adjusting mechanism reciprocable member is arranged to effect a pulling action on the cable when the reciprocable member is moved in the appropriate direction by hand crank action of the hand crank available to the treadmill user, and in one direction of rotation of same. The connection of the cable to the speed control mechanism reciprocable member is also arranged for effecting a lost motion action on the cable, whereby the cable remains stationary, when the drive motor is deenergized or turned "off" to deactivate the treadmill, and the reciprocable member of the speed control mechanism is moved by the indicated hand crank in the other of the indicated directions. When the drive motor is again and subsequently energized, the arrangement is such that the biasing action of the variable speed pulley spring biasing means draws the cable toward the motor and spring biases the pulley belt to return the indicated motor lever arm towards its maximum spacing from the treadmill head roller axis and position the pulley belt relative to the variable speed pulley for speed increasing of the treadmill belt, up to the maximum speed accommodated by the treadmill apparatus provided, depending on the amount of the lost motion that is effected when the drive motor is "off" and the speed setting hand crank is actuated.

There is thus provided by the arrangement of the invention, for use by the treadmill user when exercising on the treadmill, a speed control arrangement that, when the treadmill belt drive motor is operating to drive the treadmill, can be adjusted to provide both the minimum and the maximum speed rating provided by the treadmill assembly involved, and also, provide inifinitely variable speed control between these two speed levels, at the option of the treadmill user without dismounting from the treadmill or even stopping his exercise. Should the treadmill drive motor be deenergized or turned off to discontinue use of the treadmill for any reason, the lost motion arrangement of the treadmill speed control device accommodates manual actuation of its hand crank arrangement without overstressing results being applied to the connection of the speed controlling cable to the apparatus drive motor, when the drive motor is again energized, with the speed providing position dictated by the position of the indicated reciprocable member along its path of movement or way automatically setting the drive speed of the treadmill belt by way of the resulting positioning of the variable speed pulley and the resulting tension applied to the pulley belt, when the drive motor is energized or turned on.

Other objects, uses, and advantages will be obvious or become apparent from a consideration of the following detailed description of the application drawings in which like reference numerals indicate like parts throughout the several views.

In the drawings:

FIG. 1 is a side elevational view diagrammatically illustrating a preferred embodiment of the invention, showing the treadmill assembly in full lines at zero slope position and in phantom at its maximum slope position of the illustrated embodiment, which is 15 degrees relative to the horizontal for a 25 per cent grade, with the treadmill shown equipped with the treadmill belt speed control arrangement of the present invention;

FIG. 2 is a top plan view of the treadmill assembly as shown in its full line position of FIG. 1;

FIG. 3 is a vertical sectional view, on an enlarged scale, of the speed control mechanism that is mounted on one of the treadmill handle rails at a position and elevation convenient for grasping by the treadmill user, which forms a part of the speed control arrangement of the present invention for setting the treadmill belt at the desired speed without the treadmill user having to leave the treadmill for this purpose, or for that matter discontinue his exercising, with FIG. 3 being approximately along line 3—3 of FIG. 2, looking in the direction of the arrows;

Figures 1, 10:
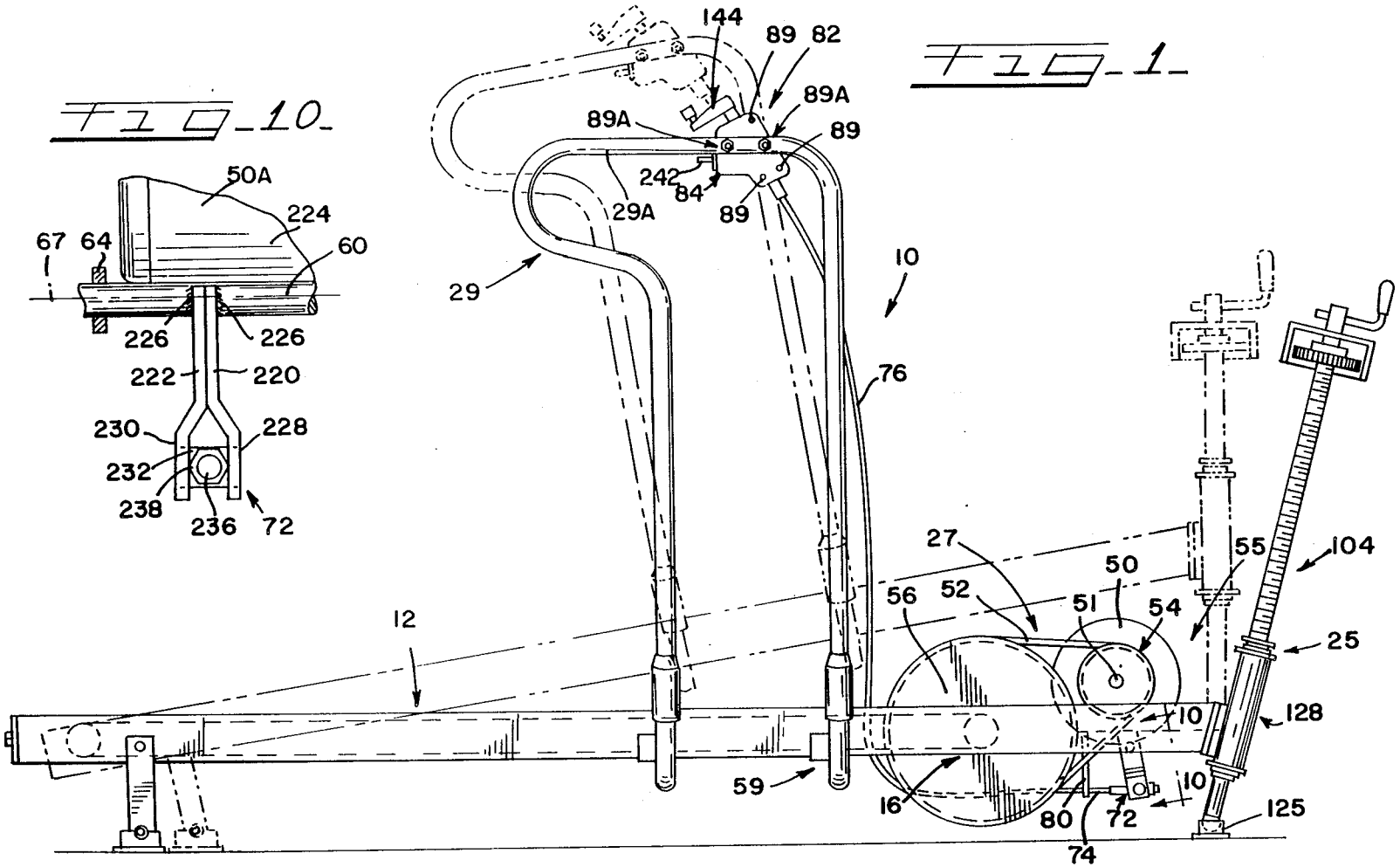
Figure 2:
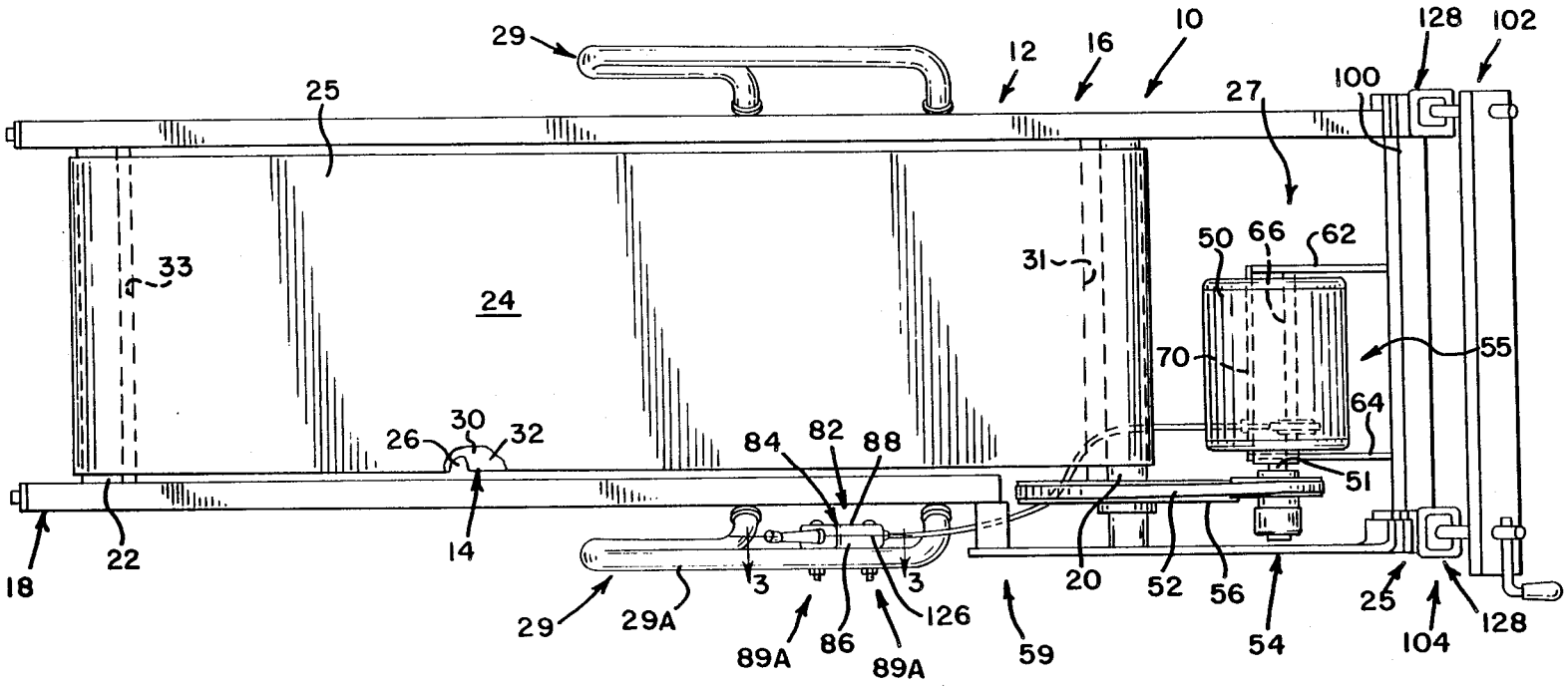
Figure 3:
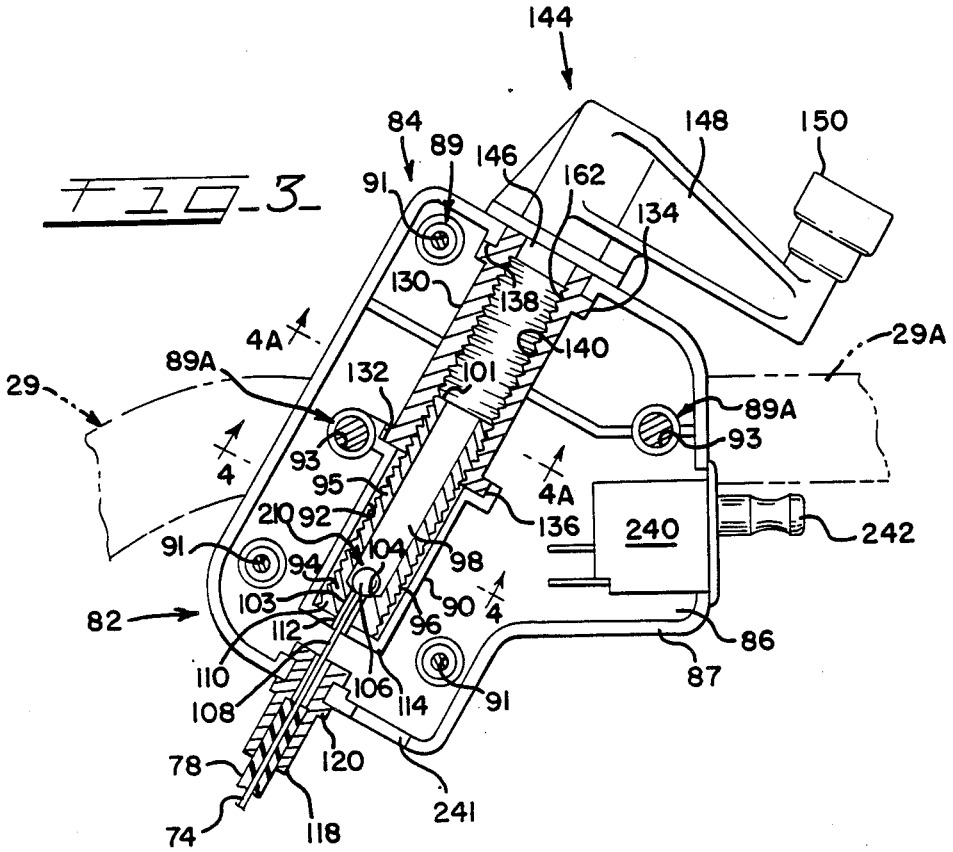
Figure 5:
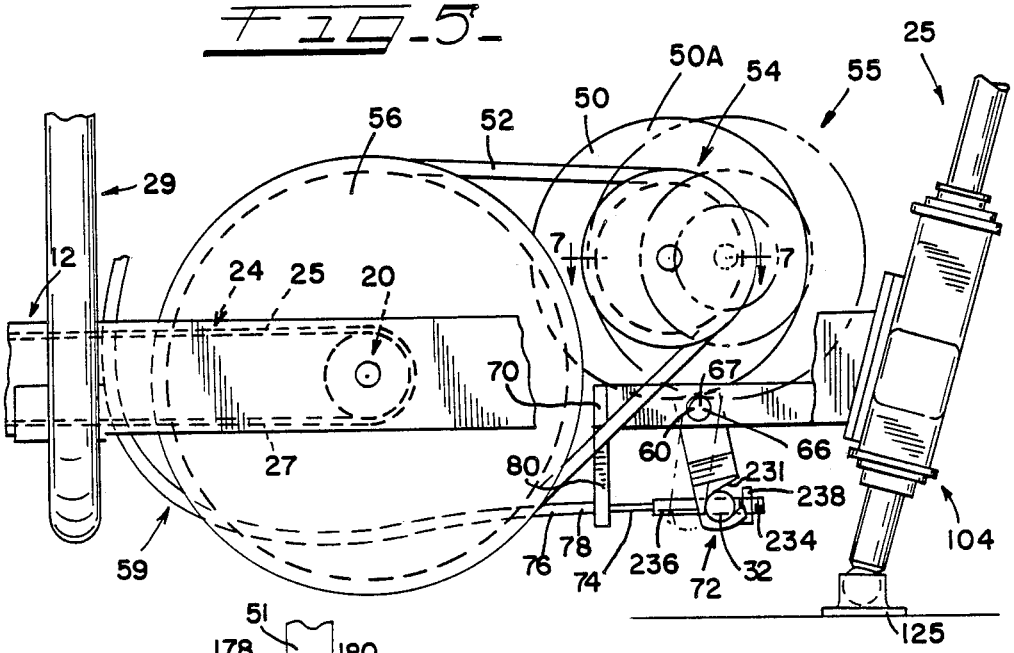
Figure 7:
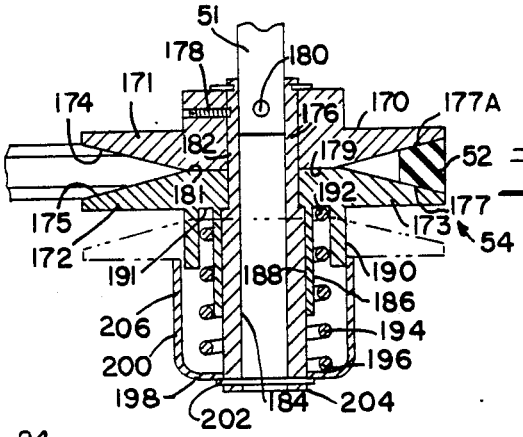
Figure 6:
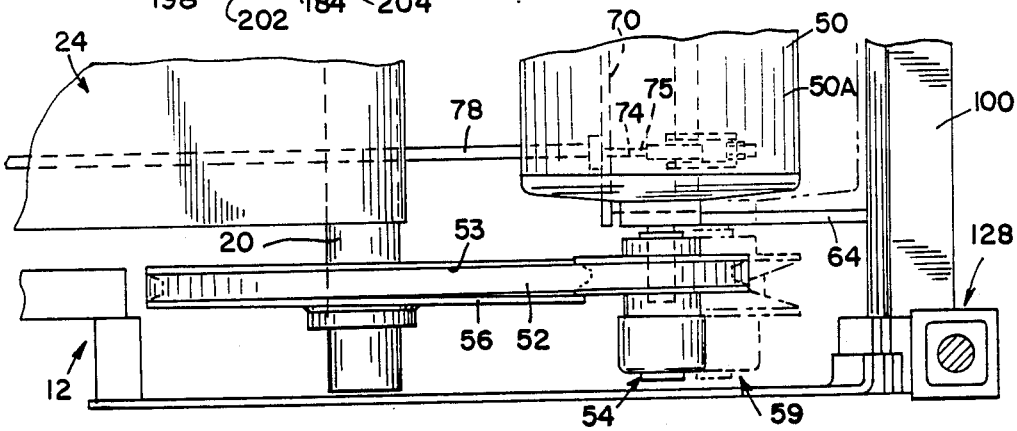
Figure 8:
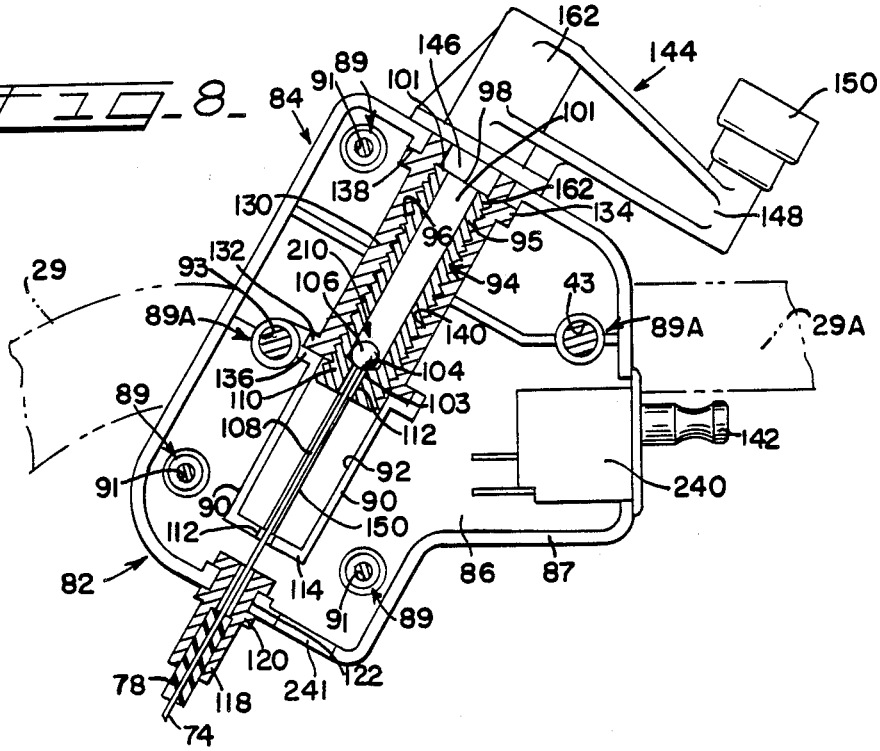
Figure 9:
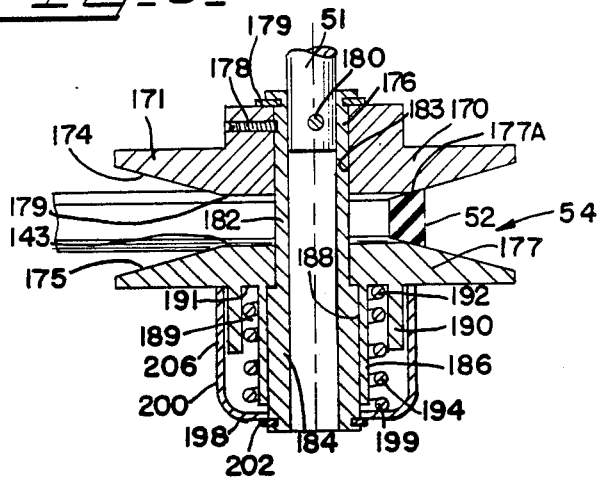

FIG. 5 is a fragmental side elevational view of the head end of the treadmill slider bed frame and drive motor assembly associated therewith, on an enlarged scale, and diagrammatically illustrating the minimum and maximum treadmill speed positions of the drive motor assembly and pulley belt, relative to the driven pulley of the treadmill belt head roller, with the full line position indicating the maximum speed position, and the phantom position indicating the minimum speed position;

FIG. 6 is a fragmental plan view of the treadmill components illustrated in FIG. 5, showing the right hand side or ends of same (with reference to the treadmill apparatus as shown in FIGS. 1 and 2), and showing in full lines the position of the apparatus drive motor assembly and pulley belt in the maximum drive speed position, and in phantom the position of the drive motor assembly and the pulley belt in the position of minimum speed;

FIG. 7 is a fragmental vertical sectional view taken substantially along line 7—7 of FIG. 5, illustrating the general arrangement of the variable speed pulley that is keyed to the drive motor and powers the pulley belt in accordance with the present invention, with the variable speed pulley in question and pulley belt being shown in the maximum speed position of these components, corresponding to the maximum speed position of the speed control mechanism shown in FIG. 3;

FIG. 8 is a view similar to that of FIG. 3, but showing the speed control mechanism at its position wherein the treadmill belt speed of the apparatus is at its minimum speed relation;

FIG. 9 is a view similar to that of FIG. 7, but illustrating the variable speed pulley as disposed for the minimum speed drive relation of the treadmill apparatus, and corresponding to the speed control mechanism position shown in FIG. 8; and FIG. 10 is a detailed fragmental view of the drive motor actuating lever.

However, it is to be distinctly understood that the specific drawing illustrations provided are supplied primarily to comply with the requirements of the Patent Laws, and that the invention is susceptible of modifications and variations that will be obvious to those skilled in the art, and which are intended to be covered by the appended claims.

Reference numeral 10 of FIGS. 1 and 2 generally indicates a diagrammatically illustrated embodiment of the invention that applied to an exercise treadmill arrangement that is similar to that disclosed in Ralph Ogden U.S. Pat. No. 4,445,683 and Ralph Ogden patent application Ser. No. 552,803 (both above identified). The treadmill assembly unit 10, which also may be termed a treadmill apparatus, generally comprises a flat or planar frame or deck 12, including a slider bed 14 extending between the forward end 16 of the frame or deck 12, and a tail or rear end 18 of same, a belt driving head roller 20 that is journalled at the head or front end 16 of the frame 12, an idler or tail roller 22 that is journalled at the rear or back end 18 of the frame 12, and an endless flexible belt 24 that is trained over the frame head driving and tail idler rollers 20 and 22, respectively, in slip free relation thereto, and extends across the slider bed 14, defining the usual upper run 25 that rides across the top surfacing of the slider bed, and a lower run 27 that returns from the tail roller 22 to the head roller 20 underneath the slider bed 14 (see FIG. 5).

As disclosed in said Ogden patents and patent application, the slider bed 14 of the treadmill 10 comprises a flat or one piece base sheet of plywood or the like 26 of rectangular outline, and proportioned to extend substantially between the locations of the head roller 20 and the tail roller 22, with the slider bed sheet 26 being proportioned such that the slider bed ends are disposed where indicated in FIG. 2 at 31 and 33. As disclosed in said patents and patent application, the slider 14 has an upwardly facing surfacing 30 that may be provided by plastic sheet 32 of film thickness dimensions, suitably fixed to the sheet 26, all as described for instance, in said Ogden U.S. Pat. No. 4,445,683 and the said Ogden patent application.

The frame or deck of the treadmill 10 is preferably, but not necessarily, equipped forwardly of the belt driving head roller 20 with a slope adjusting device 25, whereby the treadmill user may manually adjust the slope of the treadmill assembly between the two positions indicated in FIG. 1, again all as fully described, for instance, in said Ogden U.S. Pat. No. 4,445,683, and the above identified Ogden patent application. Thus, device 25 comprises a pair of slope adjusting devices 102 and 104 associated with frame cross-member 100, each of which includes a swivelly mounted foot 125. Cross-member 100 and the nut devices 128 of adjusting devices 102 and 104 are integrated into frame 12, as disclosed in, for instance, said Ogden U.S. Pat. No. 4,445,683.

The frame or deck 12 of the treadmill 10 further is equipped with side mounted hand holds 29 disposed on either side of, and intermediate the ends of the treadmill and endless belt 24 (see FIGS. 1 and 2) which are arranged in the manner disclosed in said Ogden U.S. Pat. No. 4,445,683 and the above identified Ogden patent application, which may be referred to for a full description of the manner of securing the hand holds 29 to the treadmill frame 12.

The treadmill frame or deck 12 also carries the treadmill belt drive apparatus 27, whereby the treadmill belt drive roller 20 is driven by electric drive motor 50 through pulley belt 52 engaged in drive transmitting relation, in accordance with the present invention, between variable speed drive pulley 54 that is keyed to the drive motor drive shaft 51, and the head roller drive pulley 56 that is keyed to the head roller in the manner disclosed, for instance in said Ogden U.S. Pat. No. 4,445,683. Variable speed drive pulley 54 is one of the components of speed control device 59 that forms the subject of the present invention.

As indicated in FIGS. 1 and 5, the electric drive motor 50 that is equipped with the usual drive shaft 51 is pivotally connected, as at 60, between spaced mounting plates 62 and 64, by pin 66, about a pivotal axis 67 defined by the pin 66. The mounting plates 62 and 64 are suitably affixed to the side wall of the treadmill frame cross member 100 (that is fully disclosed, for instance, in said Ogden U.S. Pat. No. 4,445,683, especially in connection with the slope adjusting devices 25).

Suitably keyed to the motor drive shaft 51 is the variable speed pulley 54, the general arrangement of which is shown in FIGS. 7 and 9, and which is adapted for application to pulley belt 52 that is of the "V" type, which belt 52 is also applied in motion transmitting relation to conventional and standard V belt pulley 56 and that is formed with a single peripheral groove 53 for application of the pulley belt 52 thereto (see FIG. 6), as distinguished from the stepping type pulleys disclosed in said Ogden patents and patent application.

The electric drive motor 50 may be of any suitable type, a ⅓ horsepower 115 volt AC 60 HC being preferred for walking exercise treadmills of the type disclosed.

The drive motor mounting plates 62 and 64 extend rearwardly of the treadmill from the cross member 100 toward the head roller and beyond the pivot axis 67 where they are joined together by cross plate 70 (using welding techniques or the like).

The drive motor 50 is part of drive motor assembly 55 and is provided with a depending lever arm 72, affixed to the housing 50A of motor 50, as by employing welding, which extends through pivot axis 67 below the plane of the frame 12 and is connected to flexible cable 74 that passes into flexible tubular housing 76 which has its adjacent end portion 78 suitably fixed to arm 80 that depends in fixed relation from cross bar 70, and thus from frame 12. Thus drive motor assembly 55 is mounted for pivotal movement about axis 67, and is connected to cable 74 for this purpose at its end 75.

The flexible cable 74, and the flexible tubular housing 76, are elongated flexible members and extend for application to the speed control mechanism 82 (of speed control device 59) that is mounted on one of the treadmill frame side mounted hand holds 29, and in the illustrated embodiment, the hand hold 29 that is on the same side as pulleys 54 and 56. Cable 74 and tubular housing per se may take the form of any conventional flexible steel shafting or cable and flexible (protective) coiled steel wire casing (sometimes called sheathing or tubing) therefor, of which a number of makes are offered commercially.

The speed control mechanism 82 generally comprises a housing 84 formed by a pair of half housing sections 86 and 88 held together at three corners (of the housing 84) by suitable nut and bolt assemblies 89 (see FIG. 1), with suitable elongate bolt assemblies 89A being employed to both hold the housing sections together and affix the assembled housing 82 to the indicated hand rail 29, and specifically to its horizontally disposed head portion 29A, which has suitable bolt holes drilled therethrough for that purpose. The housing sections 86 and 88 are complementary in arrangement and fit together at their respective marginal planar surfaces 87 and 87A that are thus disposed in coplanar relation when housing 84 is assembled (note FIGS. 4 and 4A). Housing sections 84 and 86 are each formed with suitable bolt holes 91 and 93 to receive, when assembly is progressing, the respective assemblies 89 and 89A respectively.

The hand rail head portion 29A to which mechanism 82 is secured is elevationally disposed above the treadmill belt 24 for convenient hand gripping by the treadmill user.

As indicated in FIGS. 3 and 8, the housing sections 86 and 88, which are preferably formed from a suitable plastic material, each defining a one-half section of a housing tubular member 90 of quadrilateral sectional configuration (see FIG. 4) that forms an elongate chamber 92 for non threaded, slip fit reception of reciprocating member 94 that is of elongate one piece configuration and defining external threading 96 and that is formed to define elongate bore 98 that extends from the upper end 101 of same to adjacent the lower end 103 of same where it defines an annular seat 104 for ball member 106 that is formed from a suitable plastic material and molded directly on the end 108 of cable 74, which end 108 of cable 74 thus extends through end 110 of the reciprocating member 94 as well as the bore 112 that is formed in the end 114 of tubular member 90.

As also indicated in FIGS. 3 and 8, the tubular housing 78 has molded on the end portion 116 of same a plastic tubular member 118 including a collar portion 120 that fits in the housing aperture 122 in the manner indicated in FIGS. 3 and 8, and is secured in that position when the housing halves 86 and 88 are secured together, they being provided with the indicated faces 87 and 87A that abut at parting line 126 when secured together in this relation, and in such a manner so as to form the tubular member 90 by the respective halves of same that are each an integral part of the respective housing halves 86 and 88. The housing halves 86 and 88 define opposed walls 127 and 129 that abut at parting line 126 to form chamber 92, and respectively define side cam surfaces 131 and 133 that are in guiding, relation to tubular member 90.

The housing 84 also rotatably mounts tubular rotatable member 130, that defines the respective end flanges 132 and 134 which seat against the respective housing seats 136 and 138 to journal the member 130 in the assembled housing 84. Member 130 is internally threaded as at 140 for threaded engagement with the external threading 96 of the reciprocating member 94, with the rotating member 130 being actuated by suitable hand crank 144 having stud portion 146 suitably keyed to the member 130 and fixed thereto in any suitable manner, as by these components being of complementary configuration and employing a suitable solvent cement or the like for bonding same thereto, for rendering the crank arm 144 in keyed relation to the tubular member 130. Crank arm 144 includes arm portion 148 terminating in suitably rotatable hand grip knob 150 for convenient hand gripping by the treadmill user using the treadmill 10 for walking exercise and walking between the indicated hand rails 29 as the treadmill belt upper run 25 moves from the front to the rear of the treadmill when the motor 50 is energized.

Figure 4:
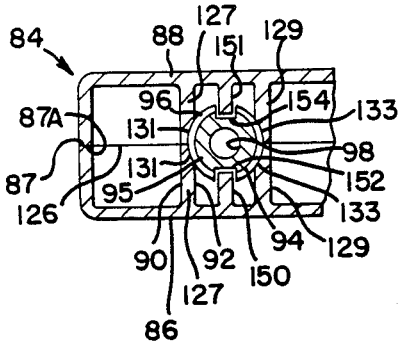
FIG. 4 is a fragmental sectional view taken substantially along line 4—4 of FIG. 3.

As indicated in FIGS. 4, the housing half sections 86 and 88 in defining the tubular member 90 and its chamber 92, which as indicated in FIG. 4, are of quadrilateral cross-section, also define a pair of opposed guide flanges 150 and 151 which are in coplanar coextensive confronting relation, and are respectively received in the respective slots 152 and 154 (in slip fit relation thereto) that are formed in the external side wall 95 of the reciprocating member 94, in 180 degrees spaced apart relation, and across the external threading 96 of same. The cooperation of the flanges 150 and 151 (which extend the length of member 90) in the respective slots 152 and 154 of member 94 (slots 152 and 154 extend the length of member 94) hold the reciprocating member 94 in the illustrated embodiment from rotational movement on rotation of the crank arm 144, with the reciprocating member 94 being proportioned lengthwise of same so that the flanges 150 and 151 remain in guiding relation to the member 94, and the external treading 96 thereof at the end 100 thereof remains in threaded engagement with the internal threading 140 of the rotatable member 130, even when the reciprocating member 94 is in its fully contracted or extended relations relative to the rotatable member 130 (See FIGS. 8 and 3, respectively).

The housing sections 86 and 88, as well as members 94, 106, 118, 130, and hand crank 144, may all be formed from nylon or Delrin, or their equivalents.

As indicated in FIGS. 3 and 8, rotation of the crank arm 144 in one direction will move the reciprocating member 94 a predetermined distance from its position of maximum extension from the rotatable member 130 that is shown in FIG. 3 to its position of maximum reception within the rotatable member 130, wherein its end 101 engages end shoulder 162 of the rotatable member 130.

Figure 4A:
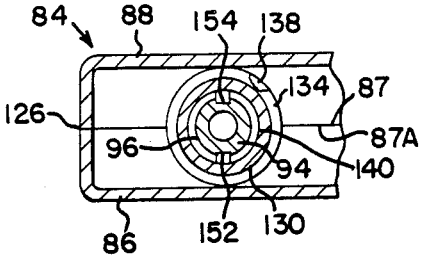
FIG. 4A is a similar sectional view taken substantially along line 4A—4A of FIG. 3.

Referring to the showing of FIG. 4A, it will be seen that the reciprocating member 94 is in coaxial relation with the rotating member 130, with the threading 96 thereof in threaded engagement with the internal threading 140 of the tubular member 130.

The general arrangement of the variable speed pulley 54 is indicated in FIGS. 7 and 9. The pulley 54 thus comprises a sheave section 170 and a sheave section 172 that are in coaxial confronting relation, with the sheave section 170 defining the usual circular flange 171 formed with the usual conically shaped face 174 that is shaped in conforming relation to the slope (fifteen degrees in one embodiment) of side surfacing 177A on one side of the pulley belt 52. Pulley half 170 is suitably fixed to tubular member 176 that receives the motor drive shaft 51, or suitable keyed extension thereto, as by employing a suitable keying arrangement. For this purpose sheave half 170 is shown keyed to tubular member 176 by suitable set screw 178, while the tubular member 176 is shown keyed to the motor drive shaft 51 by suitable set screw 180, and suitable lock ring 179 holds tubular member 176 in place longitudinally of the sheave half 170 bore 181, but, of course, any suitable keying arrangement of this type may be employed to suitably key the sheave half 170 and hub 176 to the motor drive shaft 51.

The tubular member 176 of sheave half 170 of the specific pulley 54 illustrated includes cylindrical portion 182 and elongate quadrilaterally shaped portion 184, with the sheave half 172 being reciprocably mounted on the tubular member 176 and defining sleeve portion 186 having its bore 188 shaped to complement slip fit style the external configuration of the external portion of the tubular member portion extension 184 (which is hex shaped in a preferred embodiment). The sheave half 172 also defines annular flange 190 forming spring seat pocket 189 having a seat 191 onto which one end 192 of compression spring 194 seats, with the other end 196 of the compression spring 194 seating against the end wall 198 of spring housing 200 that in turn seats against the locking ring 202 applied to suitable slotting formed in the end 204 of the extension 184 for this purpose. The spring housing 200 includes imperforate side wall 206 that is in enclosing relation to the annular flange 190 of the sleeve half 172 for the purpose of shielding the compression spring 194 from view and protecting it from foreign matter.

The sheave half 172 also defines circular flange 173 formed with the usual conical shaft face 175 that is shaped in conforming relation to the side surfacing 177 (fifteen degrees in one embodiment) on the other side of pulley belt 52.

The variable speed pulley 54, by the action of the compression spring 194 acting between the sheave half 172 and the locking ring 202, biases the sheave halves 170 and 172 together, as indicated in FIG. 7, in which condition their confronting planar faces 179 and 183 are in abutting relation and their conically shaped surfaces 174 and 175 have shifted the pulley belt 52 to adjacent their outer margins of the respective sheave halves 170 and 172. This disposes the pulley 54 for maximum angular motion application to pulley belt 52, which is thus tensioned the maximum amount, under the biasing action of the compression spring 194, for transmittal of the speed of rotation to the head roller 20 that provides the maximum treadmill belt speed for the equipment provided.

When the variable speed pulley 54 is in the position of FIG. 9, the converse is true, with the pulley belt 52 being seated between the pulley halves 170 and 172 in the space that separates the sheave half planar surfaces 179 and 183, with the pitch diameter of belt 52 remaining in contact with the respective conical sheave surfaces 174 and 175. The compression spring 194 is thus compressed in shifting the varible speed pulley from the relation of FIG. 7 to the relation of FIG. 9, under the control of mechanism 82. The shaping of the pulley halve surfaces 174 and 175, and the pulley belt sides 177A and 177 should be similar, and angulation of about fifteen degrees is preferred.

This shifting of the variable speed pulley components is effected in accordance with the present invention by operation of the speed control mechanism 82 by the treadmill user using crank arm 144. When the components of speed control device 59 have the condition of FIG. 3 (and the full line position of FIG. 5), the reciprocating member 94 is disposed in its position of maximum extension from the rotatable member 130, and the ball 106 of the cable 74 is seated against its seat 104, with the component parts of the speed control device 59 being biased to this condition by the biasing action of the spring 194 of the variable speed pulley 54 to dispose the pulley belt 52 in the position of FIG. 7; the same biasing action is effective to thrust the motor 50 in a counterclockwise direction about pivotal axis 67, with a corresponding movement of lever arm 72, which movement is stopped by the cable ball 106 seating against its seat 104. Thus, the spring biasing action of the compression spring 194 is transmitted through sheave halves 170 and 172, pulley belt 52, to motor 50, and its lever arm 72 to cable 74 and the reciprocating member 94 to form the maximum speed position of the speed control arrangement involved for the treadmill belt 24 (see FIG. 3).

Rotation of the speed control hand crank 144 in the direction to move the reciprocating member 94 to the position of FIG. 8 (threading 96 and 140 being suitably configured for this purpose) applies a pulling action on cable 74 that moves the motor 50 and its lever arm 72 in the opposite direction against the biasing action of spring 194, with the result that the pulley belt 52 is shifted from the position of FIG. 7 to the position of FIG. 9, which thus compresses the compression spring 194 and shifts the pulley belt 52 to its position of minimum speed transmitted to the pulleys and to the head roller 20 (which is the phantom line position of device 59 in FIGS. 5 and 6).

A basic feature of this invention is that should the drive motor 50 be deenergized or turned off while the reciprocating member 94 is at any position other than that shown in FIG. 3, the hand crank 144 can be turned at will without subjecting the treadmill 10 to damage, especially in the area of the connection of cable 74 to drive motor lever 72. The static friction relationships of the belt sides 177A and 177 acting on the faces 174 and 175 of the pulley 54, and the corresponding faces of the pulley 56, hold the motor 50 and the assembly 55 it forms a part of against pivoting action about axis 67 should the hand crank 144 be turned in the direction that will move the reciprocating member 94 and cable 74 downwardly of FIG. 3, the reciprocating member 94 having a lost motion connection 210 with cable 74, that is represented by movement of the member 94 that is permitted downwardly of FIG. 3, relative to cable 74, when hand crank 144 is turned to move member 94 downwardly of FIG. 3 when motor 50 is deenergized. Movement of the reciprocating member 94 and cable 74 in the opposite direction, when the motor 50 is deenergized, will shift the motor and the assembly 55 it forms a part of about the axis 67 away from the head roller 20, that is in a clockwise direction as viewed in FIG. 5, but on release of the hand crank 144, the motor 50 and assembly which it forms a part will remain in stationary relation due to the indicated static friction relationships referred to, until the motor 50 is energized. In either case, the start up of the motor will free the static friction relationships involved and permit the biasing action of spring 194 to return all components of device 55 to the speed position dictated by the position of member 94 along its permissible movement path, whereby damage to the treadmill equipment at the connection of cable 74 to motor assembly lever 72, and especially kinking of cable 74 is avoided. Thus, cable 74 acts in "pull" only, under the action of hand crank 144, or under the biasing action of spring 194 when motor 50 is running, again under the action of hand crank 144. The indicated lost motion action avoids the cable 74 being subject to any "pushing" action generated by the operation of hand crank 144.

Referring specifically to FIG. 10, it will be seen that the lever 72 comprises a pair of bars 220 and 222 fixed to the drive motor housing 224 as by welding at 226 to provide the respective depending end portions 228 and 230 which are shaped to be spaced apart from each other and be slotted as at 231 to receive cylinder 232 that is internally threaded to receive the externally threaded surfacing 234 of sleeve 236 that is molded on the cable 74, at its end 75, for the purpose of connecting the cable end 75 in question to the lever 72. Nut 238 applied to sleeve 236 holds cylinder 232 in place, as does the biasing action of pulley spring 194.

The actuation mechanism housing 84 is also arranged to mount suitable off-on switch 240 that has its terminals suitably connected to wiring (not shown) leading from housing 84 through housing opening 241 (defined by both housing sections 86 and 88 as assembled), to motor 50 and a source of electrical power supply, so that the motor 50 can be turned on or off by actuating suitable off-on switch arm 242, when the treadmill user is through exercising. Again, the shutting off of the treadmill 10 can be effected without the user first dismounting from the treadmill.

Mechanism 82 is preferably mounted for convenience of operation by the treadmill user, which is normally in the range of from about three feet to about four feet above the treadmill belt upper run 25.

It will therefore be seen that the treadmill belt speed control arrangement or device 55 provided by this invention, gives the treadmill user speed control of the treadmill belt without having to dismount from the treadmill to change its speed. The user may continue in his walking position on the treadmill, with the treadmill operating conveniently positioning of mechanism 82 at or between the minimum and maximum speed relations provided by the position of the reciprocating member 94 along its path of movement within housing 84, by using hand crank 144, which gives the treadmill user, between said maximum and minimum speed positions infinite speed control relation between such the indicated minimum and maximum speed positions. Shut off of the treadmill 10 may also be effected, without leaving the treadmill first, using switch 240.

When the treadmill is turned off, as by the drive motor 50 being deenergized, the speed control arrangement of this invention has the aforementioned lost motion built in safety factor in connection with the organization of the speed control device 55, in that movement of the crank arm 144 so as to exercise a pull on the cable 74 will change the orientation of the drive motor assembly about the pivot axis 67, but should the crank arm 144 be moved in the opposite direction, the reciprocating member 94 will move downwardly of the cable 74 and its end ball 106, with the latter being held stationary by the indicated static frictional relationships of the pulley belt 52 relative to the side surfaces of the pulleys 54 and 56 engaging same. When the drive motor 50 again is energized, the static friction relationships are broken up, and the spring biasing action of the adjustable speed pulley compression spring 194 draws the cable 74, through lever 72, to the position of speed of the treadmill belt that is dictated by the position of member 94 along its way of path of movement with the ball 106 seating against its seat 104. The lost motion arrangement provided by the speed control device 55, and specifically its mechanism 82, and the biasing action of pulley spring 194, act to return the speed of the treadmill belt dictated by the position of member 94 along its available movement path, thus avoiding damage to the treadmill drive equipment involved, and specifically the connection of cable 74 and 75 to lever 72 (thereby avoiding a structurally complicated fitting at this critical location). In this connection it is to be noted that belt 24 should be in slip free tightness with respect to rollers 20 and 22, thus limiting the flexibility of the equipment insofar as start up is concerned.

When the treadmill belt is running at the speed range provided through the operative motion provided by drive motor assembly 55 and the motion transmitting components involved including the pulleys 54 and 56 and belt 52, the user of the treadmill in exercising on the belt 24 can use the swing arm 144 of the control device 82 to give the treadmill belt any desired specific speed between its minimum and maximum speeds for which the particular apparatus involved is designed to provide. For a specific embodiment of the invention, the speed control is arranged to provide a speed of 2.0 miles per hour for the minimum speed and 3.5 miles per hour for the maximum speed.

Variable speed pulleys of the type represented by reference numeral 54 are commercially available components, currently available from, for instance, Torque Transmission, 1244 High Street, Fairport Arbor, Ohio.

The shifting of the components of the variable speed pulley 54 involves some motion of the pulley belt 52 axially of the motor drive shaft 51 (as indicated by FIGS. 2 and 6). However, the amount of sidewise movement of the pulley belt 52 at the location of pulley 54 is well within the tracking capabilities of the belt 52 relative to both pulleys 54 and 56, assuming normal tensioning of the belt 52 in the minimum low speed driving relation.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

We claim:

1. In an exercise treadmill including a generally planar slider bed having a head end, a tail end, and a top surfacing extending substantially between said ends thereof, an endless treadmill belt trained over said slider bed defining an upper belt run overlying said slider bed top surfacing and a lower run passing under said slider bed, and means for driving said belt for movement of said belt upper run from said head end to said tail end of said slider bed, including a head roller journalled in said slider bed adjacent the head end of same over which the belt is trained, said head roller being journalled for rotation about an axis extending transversely of said treadmill belt, an electric drive motor assembly mounted on the slider bed ahead of said head roller for pivotal movement about an axis paralleling that of said head roller, said drive motor assembly including a drive motor driving a drive shaft about an axis paralleling said motor assembly pivot axis and having keyed to same a first drive pulley, with said head roller having keyed to same a second drive pulley, a pulley belt in drive transmitting relation between said pulleys, said head pulley axis and said drive shaft axis being in substantially coplanar relation in a plane paralleling said slider bed, said motor assembly pivot axis being disposed below said plane and between said motor assembly and the cross member, an adjustable speed control arrangement for setting the speed of said movement of said treadmill belt, said speed control arrangement comprising:

said first drive pulley being a variable speed pulley, said motor assembly having a depending lever arm extending through and below said motor assembly pivot axis, a manually actuated speed control mechanism mounted on the treadmill above the treadmill belt and intermediate said slider bed ends, said mechanism including a reciprocable member and hand crank means for moving said reciprocable member in opposite directions a predetermined distance, a cable connected between said lever arm, below said motor assembly pivot axis, and said mechanism reciprocable member, a flexible cable guide through which said cable extends having one end anchored to said bed adjacent said lever and the other end anchored to said mechanism, said first drive pulley including spring biasing means for biasing same to the high speed position whereby said pulley belt is tensioned to swing said drive motor assembly about its said pivot axis to maximize the spacing of said lever arm from said head roller axis and said treadmill belt is driven at maximum high speed, said connection of said cable to said mechanism reciprocable member including means for effecting a pulling action on said cable when said reciprocable member is moved by said hand crank means in one of said opposite directions for speed reduction of said treadmill belt, and means for effecting a lost motion action on said cable when said reciprocable member is moved by said hand crank means in the other of said directions when said motor is deenergized, and for permitting said biasing action of said first drive pulley spring biasing means to bias said cable through said pulley belt and said lever to return said lever arm toward said maximum spacing from said head roller axis for speed increasing of said treadmill belt when said motor is running.

2. The speed control arrangement set forth in claim 1 wherein:

said slider bed has a hand rail structure secured thereto on one side of same, said hand rail structure having a hand grip portion elevationally disposed above said treadmill belt upper run for convenient grasping by a human user of the treadmill when said drive motor is driving said belts, said mechanism being mounted on said hand rail structure adjacent said hand grip portion thereof with said hand crank thereof disposed for actuation by the human user when said drive motor is driving said belts.

3. The speed control arrangement set forth in claim 1 wherein:

said first drive pulley comprises a pair of sheave halves biased toward each other by its said spring biasing means, said second drive pulley comprising a sheave with side walls in fixed spaced apart relation.

4. The speed control arrangement set forth in claim 1 wherein:

said slider bed includes a depending arm below said plane to which said one end of said cable guide is anchored.

5. The speed control arrangement set forth in claim 1 wherein:

said pulley belt is a V belt, and said first and second pulleys each define confronting side wall surfaces shaped to complement the side surfacings of said V belt, said V belt surfaces and said surfacings being in sufficient frictional holding relation when said drive motor is deenergized to hold said V belt, and thus said cable, stationary when said drive motor is deenergized.

6. In an exercise treadmill including a generally planar slider bed having a head end, a tail end, and a top surfacing extending substantially between said ends thereof, an endless belt trained over said slider bed top surfacing and a lower run passing under said slider bed, and means for driving said belt for movement of said belt upper run from said head end to said tail end of said slider bed, said slider bed having a cross member extending transversely thereof adjacent and fowardly of said head end thereof, said belt driving means comprising: a head roller journalled in said slider bed adjacent the head end of same over which the belt is trained, said head roller being journalled for rotation about an axis paralleling said cross member, an electric drive motor assembly mounted on the cross member for pivotal movement about an axis substantially paralleling said cross member, said drive motor assembly including a drive motor driving a drive shaft about an axis substantially paralleling said motor assembly pivot axis and having keyed to same a first drive pulley for rotation about said drive shaft axis, with said head roller having keyed to same a second drive pulley for rotation about said head roller axis, a pulley belt in drive transmitting relation between said pulleys, said head roller axis and said drive shaft axis being in substantially coplanar relation in a plane substantially paralleling said slider bed, said motor assembly pivot axis being disposed below said plane and said motor and disposing said motor assembly in cranking relation to said head roller axis about said motor assembly pivot axis for shifting said drive shaft axis toward said head roller axis in one direction of movement about said motor assembly pivot axis, and for shifting said drive shaft axis away from said head roller axis in the opposite direction of movement about said motor assembly pivot axis, the improvement providing for setting the speed of said movement of said treadmill belt by the human user of said treadmill, said improvement comprising:

an adjustable speed control arrangement that comprises:

said first drive pulley being a variable speed pulley, said motor assembly having a depending lever arm extending through and below said motor assembly pivot axis, a manually actuated speed control mechanism mounted on the treadmill above the treadmill belt and intermediate said slider bed ends, said mechanism including a reciprocable member and hand crank means for moving said reciprocable member a predetermined distance in opposite directions, a cable connected between said lever arm, below said motor assembly pivot axis, and said mechanism reciprocable member, a flexible cable guide through which said cable extends having one end anchored to said bed adjacent said lever and the other end anchored to said mechanism, said first drive pulley including spring biasing means for biasing same to the high speed position whereby said pulley belt is tensioned to swing said drive motor assembly about its said pivot axis to maximize the spacing of said lever arm from said head roller axis and said treadmill belt is driven at maximum high speed, said connection of said cable to said mechanism reciprocable member including means for effecting a pulling action on said cable when said reciprocable member is moved by said hand crank means in one of said opposite directions for speed reduction of said treadmill belt, means for effecting a lost motion action on said cable when said reciprocable member is moved by said hand crank means in the other of said directions when said motor is deenergized, and for permitting said biasing action of said first drive pulley spring biasing means to bias said cable through said pulley belt and said lever to return said lever arm toward said maximum spacing from said head roller axis for speed increasing of said treadmill belt when said motor is running, said movement of said reciprocable member in said one direction said predetermined distance defining the minimum low speed position of said first drive pulley and minimizing the spacing of said lever arm from said head roller axis whereby said treadmill belt is driven at minimum speed, said hand crank means being operable by the treadmill user to set said reciprocating member along said distance as desired for providing infinitely variable speed adjustment of said treadmill belt between said minimum and maximum speeds thereof, when said motor is running.

7. The speed control arrangement set forth in claim 6 wherein:

said slider bed has a hand rail structure secured thereto on one side of same, said hand rail structure having a hand grip portion elevationally disposed above said treadmill belt upper run for convenient grasping by the human user of the treadmill when said drive motor is driving said belts, said mechanism being mounted on said hand rail structure adjacent said hand grip portion thereof with said hand crank thereof disposed for actuation by the human user when said drive motor is driving said belts.

8. The speed control arrangement set forth in claim 7 wherein:

said first drive pulley comprises a pair of sheave halves biased toward each other by its said spring biasing means, said second drive pulley comprising a sheave with side walls in fixed spaced apart relation.

9. The speed control arrangement set forth in claim 8 wherein:

said slider bed includes a depending arm below said plane to which said one end of said cable guide is anchored.

10. The speed control arrangement set forth in claim 9 wherein:

said pulley belt is a V belt, and said first and second pulleys each define confronting side wall surfaces shaped to complement the side surfacings of said V belt, said V belt surface and said surfacings being in sufficient frictional holding relation when said drive motor is deenergized to hold said V belt, and thus said cable, stationary when said drive motor is deenergized.

* * * * *